United States Patent [19]

Salvi

[11] Patent Number: 5,023,997

[45] Date of Patent: Jun. 18, 1991

[54] PAIR OF NIPPERS

[75] Inventor: Jean-Francois Salvi, Vesenaz, Switzerland

[73] Assignee: Sipel Electronics S.A., Vesenaz, Switzerland

[21] Appl. No.: 445,435

[22] Filed: Dec. 4, 1989

[30] Foreign Application Priority Data

Dec. 7, 1988 [CH] Switzerland ..... 4532/88

[51] Int. Cl.[5] ..... B26B 12/00

[52] U.S. Cl. ..... 30/175; 30/28

[58] Field of Search ..... 30/176, 175, 179, 186, 30/187, 192, 28; 128/354

[56] References Cited

U.S. PATENT DOCUMENTS 2,202,340 5/1940 Faist ..... 30/176

FOREIGN PATENT DOCUMENTS 375296 3/1964 Switzerland ..... 30/175

*Primary Examiner*—Douglas D. Watts
*Assistant Examiner*—Willmon Fridie, Jr.
*Attorney, Agent, or Firm*—Darby & Darby

[57] ABSTRACT

The pair of nippers, of the tweezer type, is equipped with a removable auxiliary actuating lever (5) made of one bent piece, one part of which is in the form of a loop (7) surrounding the pair of nippers. The auxiliary lever is positioned at an intermediate point on the pair of nippers by a lug (8) engaging in a hole (9, 10) on the pair of nippers, or by another means.

6 Claims, 1 Drawing Sheet

PAIR OF NIPPERS

FIELD OF THE INVENTION

The present invention relates to a pair of nippers made of two flexible arms connected to one another by one of their ends, that is to say a pair of nippers of the tweezer type.

PRIOR ART

Cutting tweezers, for example, are known, that is to say tweezers the end of which forms cutting nippers, which are widely used to cut metal wires, in particular on printed circuits. Now a relatively great force is required to ut a metal wire, even a very thin metal wire. When the operation is repeated throughout the day, the hand becomes very tired. Furthermore, it is easier to close the tweezers by squeezing them, between the thumb and index finger, very close to the cutting end thereof. In addition, in particular in printed circuits, the elements mounted on the printed circuit often prevent the tweezers from being squeezed near their cutting ends and the user is forced to squeeze the tweezers at a point relatively far from the cutting ends, that is to say at a point where closure of the tweezers requires a much greater effort and fatigue is experienced much more quickly.

The object of the present invention is to facilitate use of a pair of nippers of the abovementioned type, in particular cutting tweezers, by as simple as possible means.

SUMMARY OF THE INVENTION

The pair of nippers according to the invention is characterised by the fact that it is equipped with a removable auxiliary actuating lever made of one bent piece, one part of which is in the form of a loop or cutout surrounding the pair of nippers, positioning means being provided to position the auxiliary lever at an intermediate point on the pair of nippers. According to a preferred embodiment of the invention, the auxiliary lever is made of a bent strip, the rectangular loop or cutout of which is equipped with a lug engaging in a hole on the pair of nippers for the positioning thereof. A positioning hole is provided on the two branches of the pair of nippers, in such a manner that the auxiliary lever may be placed on either side of the pair of nippers, in particular to allow actuation of the auxiliary lever by the index finger both for a right handed person and for a left handed person or to allow actuation either by the index finger or by the thumb.

The force obtained by means of the auxiliary lever makes it possible to produce nippers of the tweezer type for other uses, for example bending nippers equipped with a profile, nippers for straightening metal wire and shaping nippers. The nippers obtained are light and inexpensive. The pair of nippers could have two pairs of jaws, one for cutting and the other for bending, for example.

BRIEF DESCRIPTION OF THE DRAWINGS

The attached drawing illustrates, by way of example, an embodiment of the invention.

DESCRIPTION OF THE PREFERRED EMBODIMENT

Figure 1:
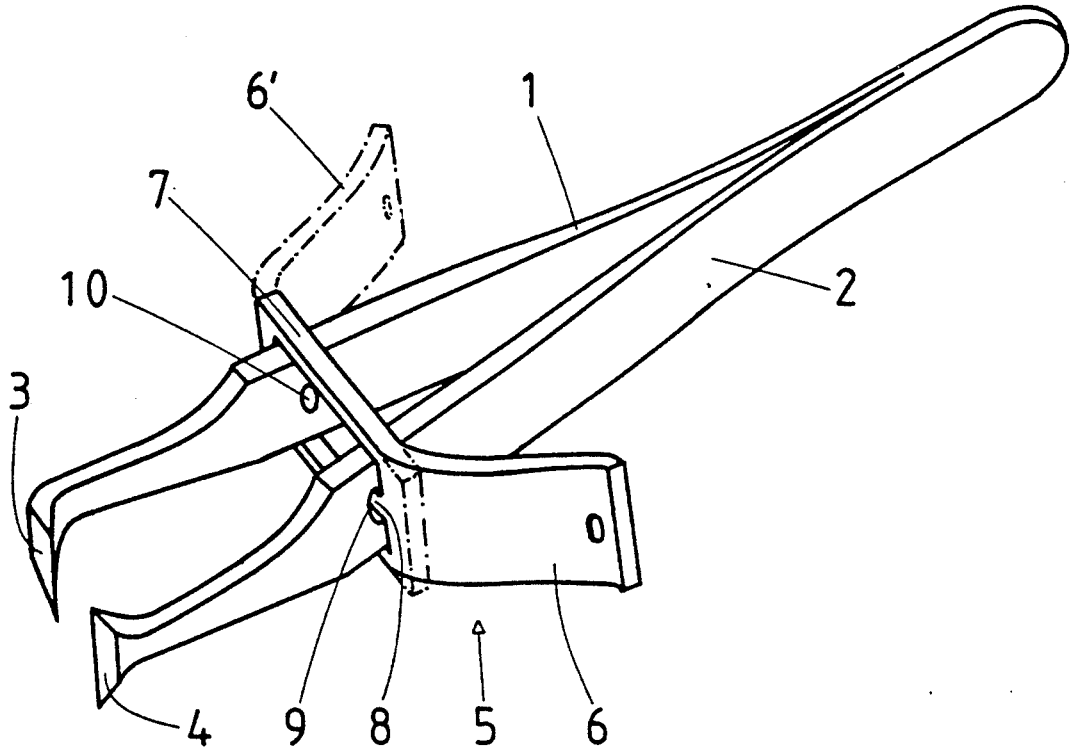
FIG. 1 illustrates open cutting tweezers at rest.
Figure 2:
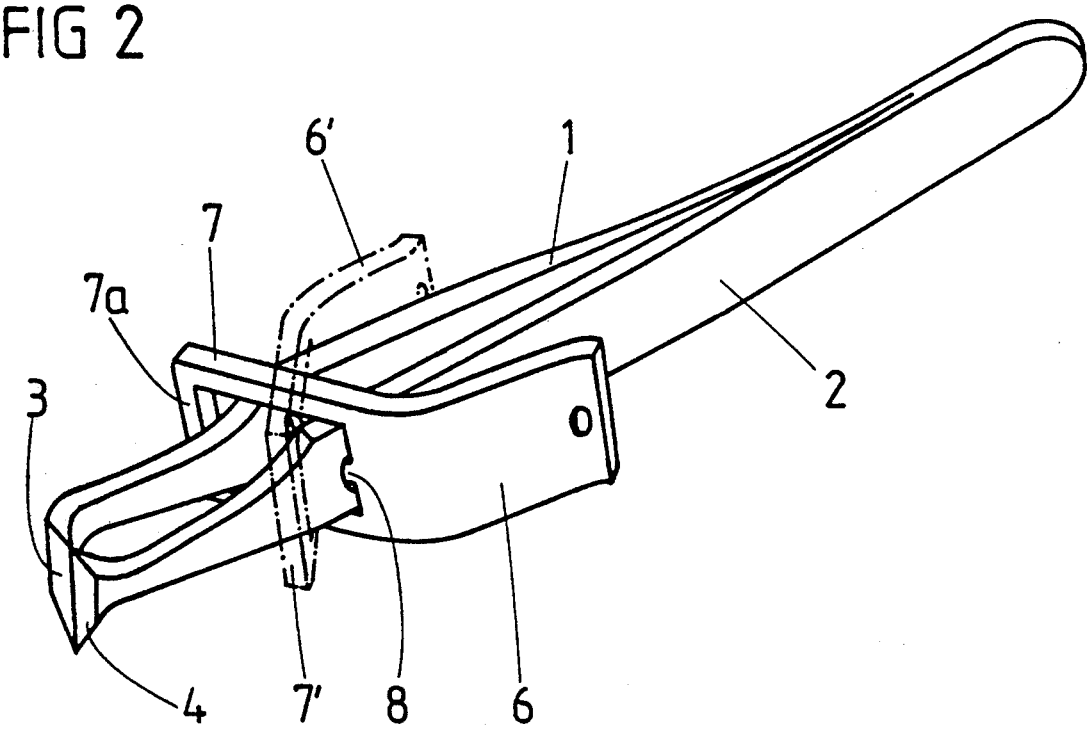
FIG. 2 is a view of the same tweezers closed, that is to say at work.

The cutting tweezers shown, of known form, have two arms 1 and 2, the ends of which are equipped with cutting jaws 3 and 4. On the tweezers is mounted an auxiliary lever 5 made of a bent strip having an actuating arm 6 and a rectangular loop or cutout 7, the length of which is such that the branches 1 and 2 of the tweezers are slightly tensioned, this tension maintaining the loop on the tweezers. The loop 7 is further equipped with a lug 8 directed towards the inside of the loop and engaged in a lateral hole 9 on one of the branches of the tweezers, the branch 2 for the position of the auxiliary lever shown in continuous line. The auxiliary lever 5 is thus positioned on the tweezers at an intermediate point between its ends. The other branch 1 of the tweezers is also equipped with a hole 10 enabling the auxiliary lever 5 to be mounted on the tweezers in such a manner that its actuating arm 6 is situated on the other side of the tweezers, at the position 6', its lug 8 then being engaged in the hole 10.

When a right handed user grasps the tweezers by resting his thumb on the arm of the lever 6, the inside of the loop 7 rests on the branch 2 forming the point of support of the lever, the opposite side 7*a* of the loop pushing the branch 1 of the tweezers. It is noted that, with a relatively short lever arm 6, it becomes very easy to grip the tweezers. It is also possible to hold the tweezers very far back from the cutting jaws, which greatly facilitate access to the wires to be cut. It is possible to cut wires of a relatively large diameter, which would be very difficult to cut with cutting tweezers without an auxiliary lever.

The auxiliary lever shown in continuous line may be actuated either by the thumb of a right handed person, or by the index finger of a left handed person and vice versa for the position 6' shown in dot-and-dash line. The cutting tweezers according to the invention offer therefore a great flexibility of use.

Variant embodiments of the cutting tweezers are possible. In particular, the loop or cutout 7 could be of a form other than a rectangular form, for example round, oval or hexagonal. Instead of a lug and a hole, the positioning means could be produced in a different manner for example by two projections provided on the outer surface of the branches, projections between which the loop would engage. The lug 8 could be provided at the other end of the loop, that is to say, for the position shown in continuous line in FIG. 1, in the hole 10; the effect of the lever would be practically the same.

I claim:

1. A pair of nippers, comprising:

a first flexible arm, a second flexible arm having one end connected to an end of said first arm;

an auxiliary actuating lever having first and second portions with a bend therebetween, said first portion having a cutout and being oriented transversely to the lengthwise dimension of said arms, each of said flexible arms extending through said cutout, a second portion of said actuating lever being subject to application of a force that pivots said lever relative to said first arm, the unconnected ends of said arms moving toward each other when said lever pivots by action of said lever on said second arm;

means for pivotably engaging said lever with said first flexible arm at an intermediate point along the length of said arm.

2. A pair of nippers as in claim 1, wherein said cutout is rectangular in shape and said means for pivotably engaging includes a positioning hole through said first arm and a lug extended from an edge of said cutout, said lug engaging said hole for said pivotable connection.

3. A pair of nippers as in claim 2, wherein said lever is removable and each said arm has a postioning hole, said lug of said auxiliary actuating lever being selectively engageable in either one of said positioning holes, said lever being positionable on either side of said pair of nippers.

4. A pair of nippers, comprising:

a first flexible arm, a second flexible arm having one end connected to an end of said first arm;

an auxiliary actuating lever having first and second positions, said first portion having a cutout and being oriented transversely to the lengthwise dimension of said arms, each of said flexible arms extending through said cutout, a second portion of said actuating lever being subject to application of a force that pivots said lever relative to said first arm, the unconnected ends of said arms moving toward each other when said lever pivots by action of said lever on said second arm;

means for pivotably engaging said lever with said first flexible arm at an intermediate point along the length of said arm.

5. A pair of nippers as in claim 4, wherein said cutout is rectangular in shape and said means for pivotably engaging includes a positioning hole through said first arm and a lug extended from an edge of said cutout, said lug engaging said hole for said pivotable connection.

6. A pair of nippers as in claim 5, wherein said lever is removable and each said arm has a positioning hole, said lug of said auxiliary lever being engageable in either one of said positioning holes, said lever being positionable on either side of said pair of nippers.

* * * * *